US008905325B2

(12) United States Patent
Ballu et al.

(10) Patent No.: US 8,905,325 B2
(45) Date of Patent: Dec. 9, 2014

(54) SPRAYING MEMBER, SPRAYING DEVICE COMPRISING SUCH A MEMBER, SPRAYING INSTALLATION AND METHOD OF CLEANING SUCH A MEMBER

(75) Inventors: Patrick Ballu, Reims (FR); Sylvain Perinet, Grenoble (FR)

(73) Assignee: Sames Technologies, Meylan (FR)

( * ) Notice: Subject to any disclaimer, the term of this patent is extended or adjusted under 35 U.S.C. 154(b) by 1263 days.

(21) Appl. No.: 12/597,330

(22) PCT Filed: Apr. 22, 2008

(86) PCT No.: PCT/FR2008/000568
§ 371 (c)(1),
(2), (4) Date: Mar. 29, 2010

(87) PCT Pub. No.: WO2008/145846
PCT Pub. Date: Dec. 4, 2008

(65) Prior Publication Data

US 2010/0193602 A1 Aug. 5, 2010

(30) Foreign Application Priority Data

Apr. 23, 2007 (FR) ..... 07 02929

(51) Int. Cl.

| | |
|---|---|
| ***B05B 3/02*** | (2006.01) |
| ***F23D 11/04*** | (2006.01) |
| ***B05B 5/10*** | (2006.01) |
| ***B44D 5/10*** | (2006.01) |
| ***F23D 11/32*** | (2006.01) |
| ***B05B 5/00*** | (2006.01) |
| ***B05B 3/10*** | (2006.01) |
| *B05B 5/04* | (2006.01) |

(52) U.S. Cl.
CPC ..... *B05B 3/1014* (2013.01); *B05B 3/1064* (2013.01); *B05B 3/1057* (2013.01); *B05B 5/0407* (2013.01)
USPC ..... 239/224; 239/223; 239/214; 239/700; 239/701; 239/702; 239/703

(58) Field of Classification Search
CPC ..... B05B 3/10; B05B 5/04; B05B 15/02; B05B 3/082
USPC ..... 239/214, 223, 224, 700–703
See application file for complete search history.

(56) References Cited

U.S. PATENT DOCUMENTS 3,009,441 A * 11/1961 Juvinall ..... 118/624
3,263,127 A * 7/1966 Point et al. ..... 361/227

(Continued)

FOREIGN PATENT DOCUMENTS

EP 1038587 A1 9/2000
EP 1754541 A1 2/2007

(Continued)

*Primary Examiner* — Len Tran
*Assistant Examiner* — Alexander M Valvis
(74) *Attorney, Agent, or Firm* — Browdy and Neimark, PLLC

(57) ABSTRACT

This spraying member (10) comprises at least one outer bowl (100) and one inner bowl (200), each bowl defining a spraying edge (101, 201), one inner spreading surface (102, 202) and one outer surface (103, 203). The inner bowl (200) is positioned radially on the inside of the outer bowl (100), whereas a volume (V1) defined between the inner surface (102) of the outer bowl (100) and the outer surface (203) of the inner bowl (200) has a thickness (e), corresponding to the distance between this inner surface (102) and this outer surface (203), decreasing between a first value (e1), taken at the zone for inlet of cleaning product into the volume (V1), and a second value (e2), taken at the spraying edge (101) of the outer bowl (100). The spraying member (10) comprises means (68) for the central supply of the inner spreading surfaces (102, 202).

13 Claims, 4 Drawing Sheets

(56) References Cited

U.S. PATENT DOCUMENTS

| | | | | | |
|---|---|---|---|---|---|
| 3,342,415 | A | * | 9/1967 | Point | 239/694 |
| 3,358,931 | A | * | 12/1967 | Wirth | 239/223 |
| 3,478,962 | A | * | 11/1969 | Wirth | 239/694 |
| 3,504,851 | A | * | 4/1970 | Demeter | 239/703 |
| 4,555,058 | A | * | 11/1985 | Weinstein et al. | 239/223 |
| 4,785,995 | A | * | 11/1988 | Yamane et al. | 239/3 |
| 4,838,487 | A | * | 6/1989 | Schneider | 239/223 |
| 5,106,025 | A | * | 4/1992 | Giroux et al. | 239/703 |
| 5,346,139 | A | * | 9/1994 | Davis et al. | 239/703 |
| 5,474,236 | A | * | 12/1995 | Davis et al. | 239/703 |
| 5,632,448 | A | * | 5/1997 | Alexander et al. | 239/703 |
| 5,788,165 | A | * | 8/1998 | Sakakibara et al. | 239/700 |
| 5,813,608 | A | * | 9/1998 | Yoshioka et al. | 239/110 |
| 5,853,126 | A | * | 12/1998 | Alexander | 239/223 |
| 5,894,993 | A | * | 4/1999 | Takayama et al. | 239/112 |
| 6,050,499 | A | * | 4/2000 | Takayama et al. | 239/112 |
| 6,053,437 | A | * | 4/2000 | Hansinger et al. | 239/703 |
| 6,328,224 | B1 | * | 12/2001 | Alexander | 239/223 |
| 6,341,734 | B1 | * | 1/2002 | Van Der Steur | 239/223 |
| 6,854,665 | B1 | * | 2/2005 | Di Gioia et al. | 239/223 |
| 6,988,673 | B2 | * | 1/2006 | Kon et al. | 239/223 |
| 7,128,277 | B2 | * | 10/2006 | Schaupp | 239/3 |
| 7,143,963 | B2 | * | 12/2006 | Tani et al. | 239/456 |
| 2005/0172892 | A1 | * | 8/2005 | Thome et al. | 118/323 |
| 2008/0245296 | A1 | * | 10/2008 | Nomura et al. | 118/300 |

FOREIGN PATENT DOCUMENTS

| | | | | | |
|---|---|---|---|---|---|
| FR | 2170940 | A1 | | 9/1973 | |
| SU | 733565 | | * | 2/1980 | A01G 25/00 |

* cited by examiner

SPRAYING MEMBER, SPRAYING DEVICE COMPRISING SUCH A MEMBER, SPRAYING INSTALLATION AND METHOD OF CLEANING SUCH A MEMBER

The present invention relates to a spraying member for a rotary sprayer of coating product, and a spraying device fitted with such a spraying member and an installation for spraying coating product incorporating such a device. The invention also relates to a method for cleaning such a spraying member.

Conventional spraying by rotating cups is used for the application on objects to be coated, such as motor vehicle bodies, of primers, the first base layer and lacquers, with paint flow rates of between 100 and 500 cc/min. In order to reduce the investments associated with the installation and with the operation of the paint lines, the motor vehicle market is tending to reduce their length and the number of spraying robots installed on these lines. Therefore, the sprayers designed to be mounted on these robots must be capable of spraying coating products with high flow rates.

Stacks of cups are known from the prior art for the purpose of increasing the spraying flow rate of liquid products. For example, FR-A-1363681 describes a liquid product spraying installation consisting of a member for spraying liquid in the form of a jet, of at least one rotary spraying member with an edge placed after it, and means making it possible to vary the quantity of sprayed product distributed to the rotary spraying member, by varying the distance between the nozzle and the disk or disks. To alleviate the fact that the capacity of the installation is usually limited by the maximum capacity of the spraying member with edge, while the spraying nozzle would allow a much greater work capacity, FR-A-1363681 proposes to use two or more spraying members with edge.

A technical problem posed by "multicup" spraying members is the cleaning of the outer surface of the inner cup or cups, dirtied during spraying where the rotation of the member creates a pressure drop between the bowls which causes droplets to be deposited on an outer surface. This surface is difficult for the solvent to reach during rinsing.

FR-A-2 170 940 describes a spraying member designed to spray two distinct products with two distinct supply means. Such supply means do not, however, make it possible to supply the two distribution surfaces of the spraying member at the same time. In addition, the construction of such a spraying member is relatively complex and prejudicial to the balance and compactness of this member.

US-A-5 894 993 describes a spraying member comprising a single inner surface for distributing coating product and an annular guide designed to guide the solvent in order to clean the outer surface of the spraying member. However, the flow rate of coating product sprayed by such a spraying member is relatively limited, because there is only one spraying edge.

It is these drawbacks that the invention is designed more particularly to remedy by proposing a balanced and compact multibowl spraying member, the geometry of which is such that it is easier to clean the outer surface of its inner bowl.

Accordingly, the subject of the invention is a spraying member for a rotary sprayer of coating product, said spraying member comprising at least one outer cup and one inner cup, each cup defining a spraying edge, an inner distribution surface and an outer surface, the inner cup being placed radially inside the outer cup, while a volume defined between the inner surface of the outer cup and the outer surface of the inner cup has a decreasing thickness between a first value, taken at a zone of inlet for cleaning product into the volume, and a second value, taken at the spraying edge of the outer cup, the spraying member being characterized in that it comprises central supply means for the inner distribution surfaces of the cups.

By virtue of the invention, the volume defined between the inner surface of the outer cup and the outer surface of the inner cup has a passageway section which narrows in the direction of progression of the cleaning product toward the spraying edge of the outer cup. Indeed, its thickness, which corresponds to the distance, taken perpendicularly to a midline of this volume, between the inner surface of the outer cup and the outer surface of the inner cup, makes it possible to control the distribution of the cleaning product in this volume. Under the effect of centrifugal force, the speed of the product increases between the cups at the same time as the diameter of the cups. For this reason, the pressure of the product between the cups tends to decrease, while the diameter of the cups increases, that is to say in the direction of flow of the product. To maintain a sufficient level of pressure of the product until it leaves the volume, the passageway section has to be reduced, which is what the invention proposes. Therefore, it is possible to completely fill this volume with cleaning product or with a mixture of cleaning product and air, which allows the cleaning product to lick both the inner surface of the outer cup and the outer surface of the inner cup. The cleaning of these inner and outer surfaces is thus optimized. Moreover, the central supply means make it possible to supply simultaneously the two inner distribution surfaces with a compact and balanced construction of the spraying member.

According to aspects of the invention that are advantageous but not obligatory, such a spraying member may incorporate one or more of the following features:

- These central supply means comprise a distributor provided with an orifice aligned on an axis of symmetry of the inner surfaces and outer surfaces of the cups, this orifice being designed to supply the inner distribution surface of the inner cup with coating product.
- The supply means comprise a deflector mounted in the inner cup, facing a central portion of the inner distribution surface.
- The ratio of the second value of the thickness of the volume over the first value of this thickness is less than 0.9, preferably less than 0.5, more preferably of the order of 0.4.
- The spraying edge of the outer cup is axially set back relative to the spraying edge of the inner cup by a distance greater than 1% of the diameter of the spraying edge of the inner cup.
- Orifices for the inlet of air towards the aforementioned volume may be provided on the outer cup.

The invention also relates to a device for spraying coating product which comprises a spraying member as specified above and means for rotating this member and means for supplying coating product to this member.

If the spraying member comprises a distributor provided with an orifice, as mentioned above, the diameter of this orifice is advantageously less than or equal to the internal diameter of the downstream end of the means for supplying coating product.

The invention also relates to an installation for spraying coating product which comprises, amongst other things, at least one spraying device as mentioned above.

Finally, the invention relates to a method for cleaning a spraying member as mentioned above, this method comprising a step consisting in completely filling the volume defined between the inner surface of the outer cup and the outer surface of the inner cup with cleaning product and/or with air.

Advantageously, a cleaning product or a mixture of cleaning products and foaming air is used for this complete filling.

The invention will be better understood and other advantages of the latter will appear more clearly in the light of the following description given only as an example and made with reference to the appended drawings in which.

Figure 1:
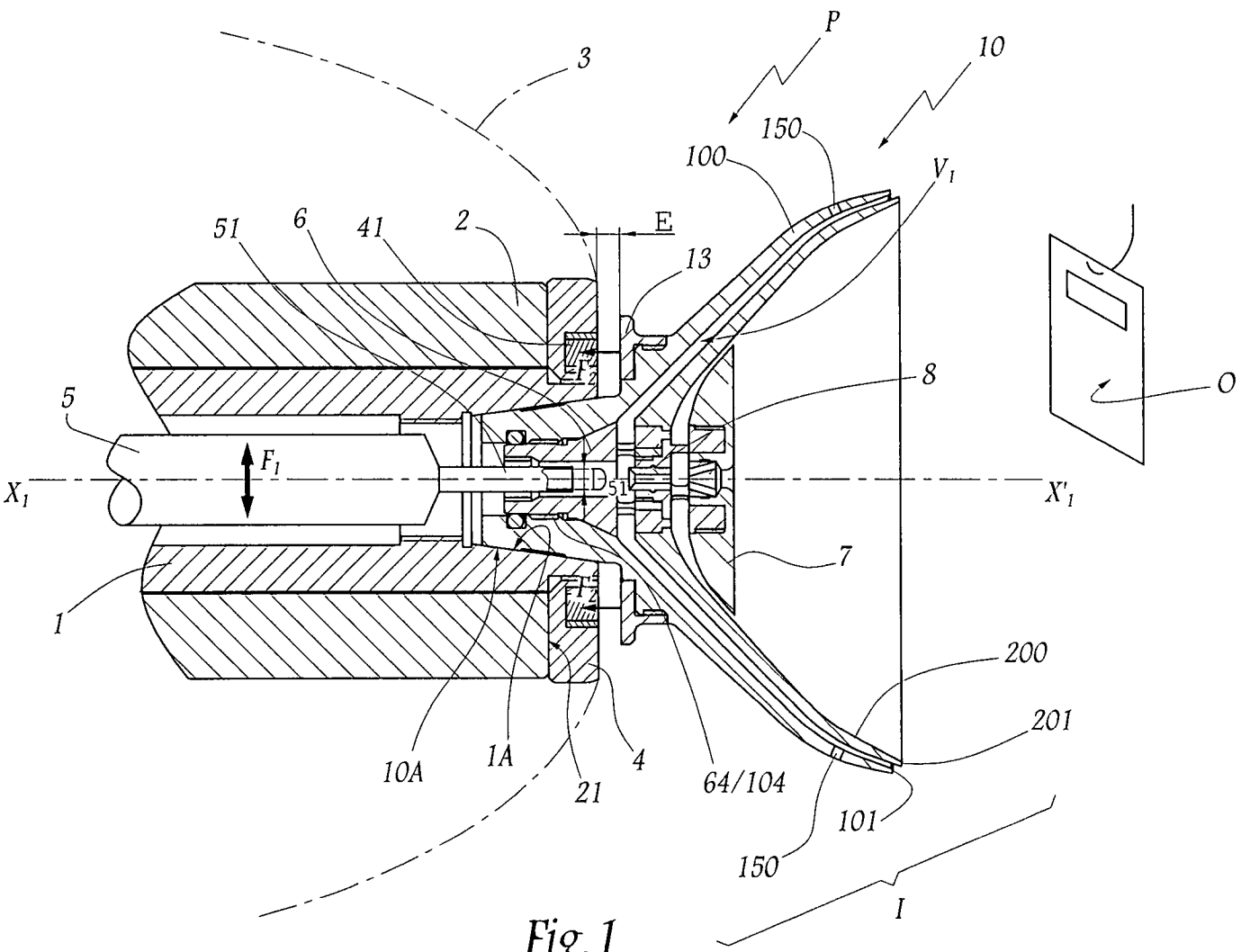
FIG. 1 is a longitudinal sectional diagram of a sprayer of coating product according to the invention used in an installation according to the invention and incorporating a spraying member according to the invention.
Figure 2:
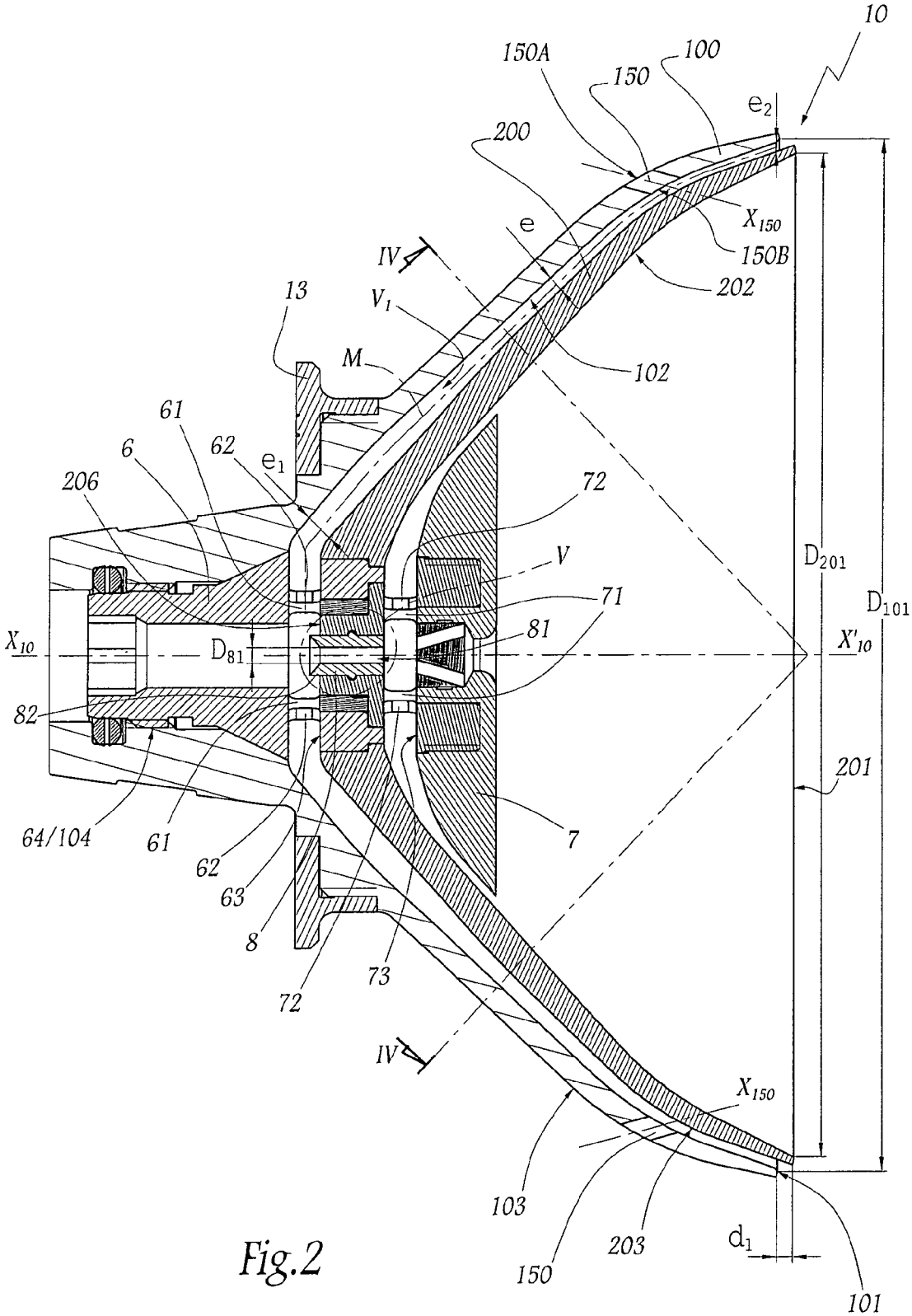
FIG. 2 is an axial section of the spraying member of FIG. 1.
Figure 3:
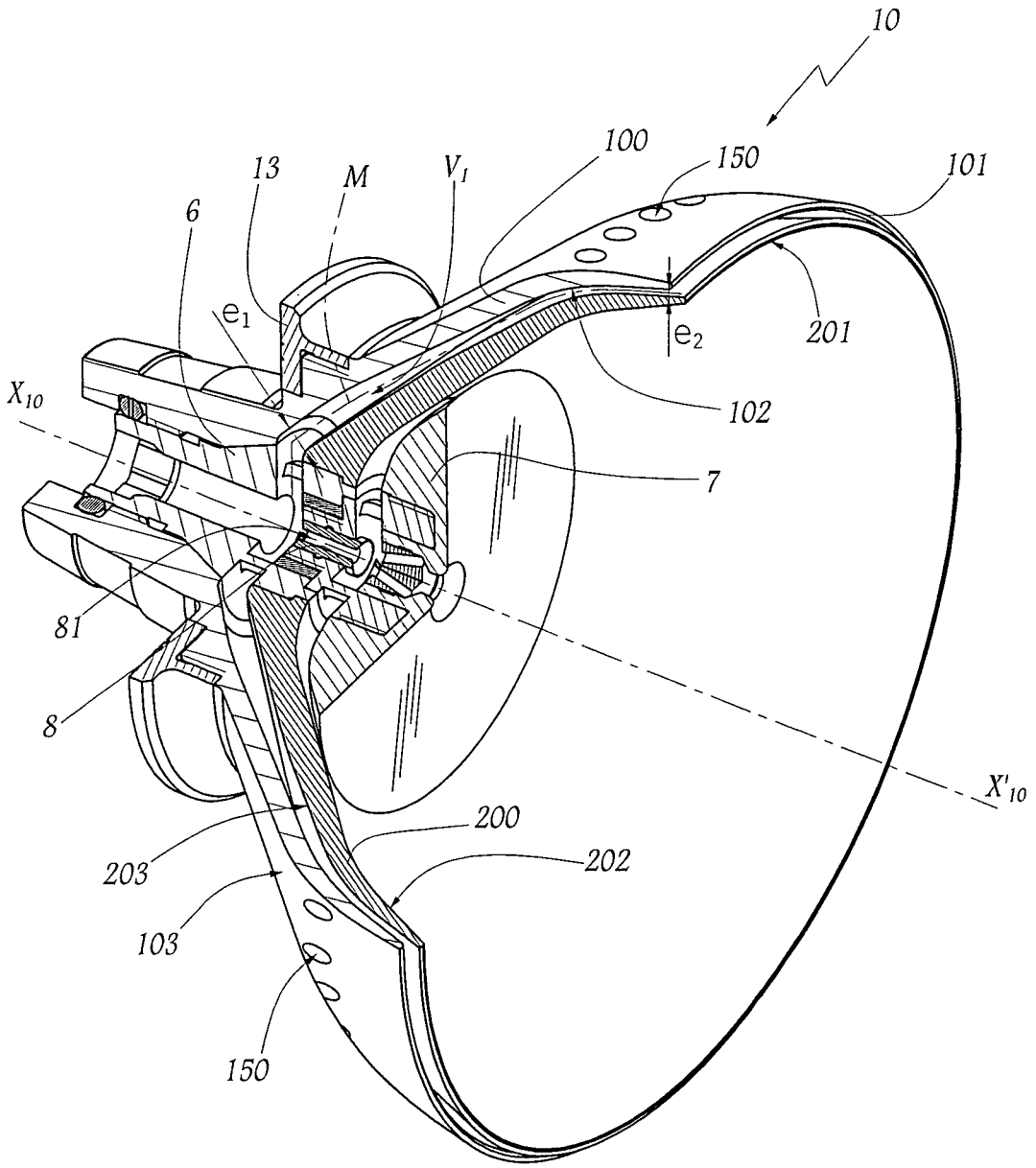
FIG. 3 is a view in perspective, with partial cutaway, of the member of FIG. 2.

The sprayer P shown in FIG. 1 is supplied with coating product from one or more sources not shown and moved, for example with an essentially vertical movement shown by the double arrow $F_1$, opposite objects O to be coated within an installation I for coating these objects. The sprayer comprises an air turbine, the sole rotor 1 of which can be seen in FIG. 1, this rotor being rotated about an axis $X_1$-$X'_1$.

A body 2, fixed relative to the axis $X_1$-$X'_1$, surrounds the rotor 1 and is itself isolated from the outside by a cover 3. An annular support 4 made of magnetic material, for example of magnetic stainless steel, is mounted on the front face 21 of the body 2, this support being provided with an annular groove that is centered on the axis $X_1$-$X'_1$ and in which an annular magnet 41 is placed. An injector 5 of coating product is aligned on the axis $X_1$-$X'_1$.

A spraying member 10 is mounted on the sprayer P and forms a frustoconical surface 10A designed to interact with a frustoconical surface 1A of the rotor 1 in order to secure the spraying member 10 and the rotor 1 in rotation. In order to ensure an effective pressing of the surfaces 10A and 1A against one another and a relative immobilization in the manner of a Morse cone, a ferrule 13 made of ferromagnetic material is mounted on the spraying member 10, so that an attractive force $F_2$ due to the magnet 41 is exerted on the ferrule 13, which firmly flattens the surfaces 10A and 1A against one another, while an air gap E is arranged between the ferrule 13 and the support 4. Application of the technical teaching of FR-A-2887472 is made here.

The spraying member 10 comprises two cups 100 and 200, of different diameters and geometries.

The outer cup 100 is provided with a spraying edge 101, a product distribution surface 102 and an outer surface 103.

The injector 5 brings the liquid product to be sprayed to the cup 100.

An inner cup 200 is attached inside the cup 100 by screwing, by virtue of a hub 6. The inner cup 200 is immobilized on the hub 6 by any appropriate means, for example by bonding. Then, the hub 6 is screwed, by virtue of a thread 64, into a tapped portion 104 of the cup 10. The two cups 100 and 200 are therefore assembled while being able to be disassembled from one another. A male centering cone is provided on the cup 200, while a matching female centering cone is provided on the cup 100. This makes it possible to ensure a permanent relative centering of these cups.

The cup 200 may be attached to the cup 100 by other mechanical means, for example by force.

The hub 6 is provided with mounts 61 between which openings 62 are arranged, in this instance in the shape of beans, for the passage of the coating product from the injector 5 to the inner surface 102 of the cup 100.

The cup 200 is provided with a spraying edge 201, a product distribution surface 202 and an outer surface 203.

The diameters of the edges 101 and 201 are marked respectively $D_{101}$ and $D_{201}$. The value of $D_{101}$ is slightly greater than that of $D_{201}$. More precisely, $D_{101}$ is greater by X to Y % relative to $D_{201}$. For example $D_{101}$ may be 63.5 mm while $D_{201}$ is 65 mm.

Screwed to the cup 200 is a distributor/deflector 7. This distributor 7 could be attached by other mechanical means. The distributor 7 is provided with mounts 71 between which openings 72 are arranged, in this instance in the shape of beans, for the passage of the coating product to the inner surface 202 of the cup 200.

An insert 8 mounted in the cup 200 defines an orifice 81 aligned on the central axis $X_{10}$-$X'_{10}$ of the member 10 which forms an axis of symmetry of the surfaces 102, 103, 202 and 203.

The insert 8 protrudes relative to the rear face 206 of the cup 200 designed to be turned toward the injector 5. The portion 82 of the insert 8, which protrudes relative to the surface 206 has an inner surface that is convergent in the direction of the edge 201 and may be considered to be a funnel.

Figure 6:
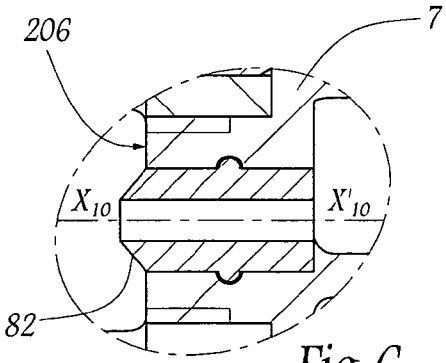
FIG. 6 is a view similar to FIG. 5 for a second embodiment of the invention.

As a variant, as shown in FIG. 6, the portion 82 of the insert 8 protruding relative to the surface 206 may be in the form of an "inverted funnel", with an external surface that is divergent in the direction of the edge 201 and an inner cylindrical surface with a circular base.

According to another variant that is not shown, it is possible for the insert 8 not to protrude beyond the surface 206.

The three shapes of the insert 8 envisaged above make it possible to have an influence on the distribution of the product between the flow paths formed by the surfaces 102 and 202 of the two cups. Various types of cups may therefore be provided, with inserts 8 of different geometry.

The edges 101 and 201 are not in the same plane; they are offset axially from one another, the edge 101 being set back relative to the edge 201, in order to prevent as much as possible the jets of sprayed product from recombining, that is to say mixing with one another. "Set back" means that the edge 101 is further from the objects O than the edge 201. It is appropriate to separate as much as possible the jets of coating product originating from the edges 101 and 201. Indeed, if the jets recombine, the size of the droplets increases, while an even spray requires droplets that are as fine as possible.

For example, the distance $d_1$ by which the edge 101 is set back relative to the edge 201 may be 10 millimeters for a cup of which the edge 201 has a diameter of the order of 65 mm. In practice, the distance $d_1$ represents more than 1% of the diameter $D_{201}$ of the edge 201, which ensures a good separation of the jets of product without axially lengthening the cup too much. The greater this distance, the less the jets of sprayed product recombine.

The inner surface 102 of the cup 100 and the outer surface 203 of the cup 200 define between them a volume $V_1$.

Figure 4:
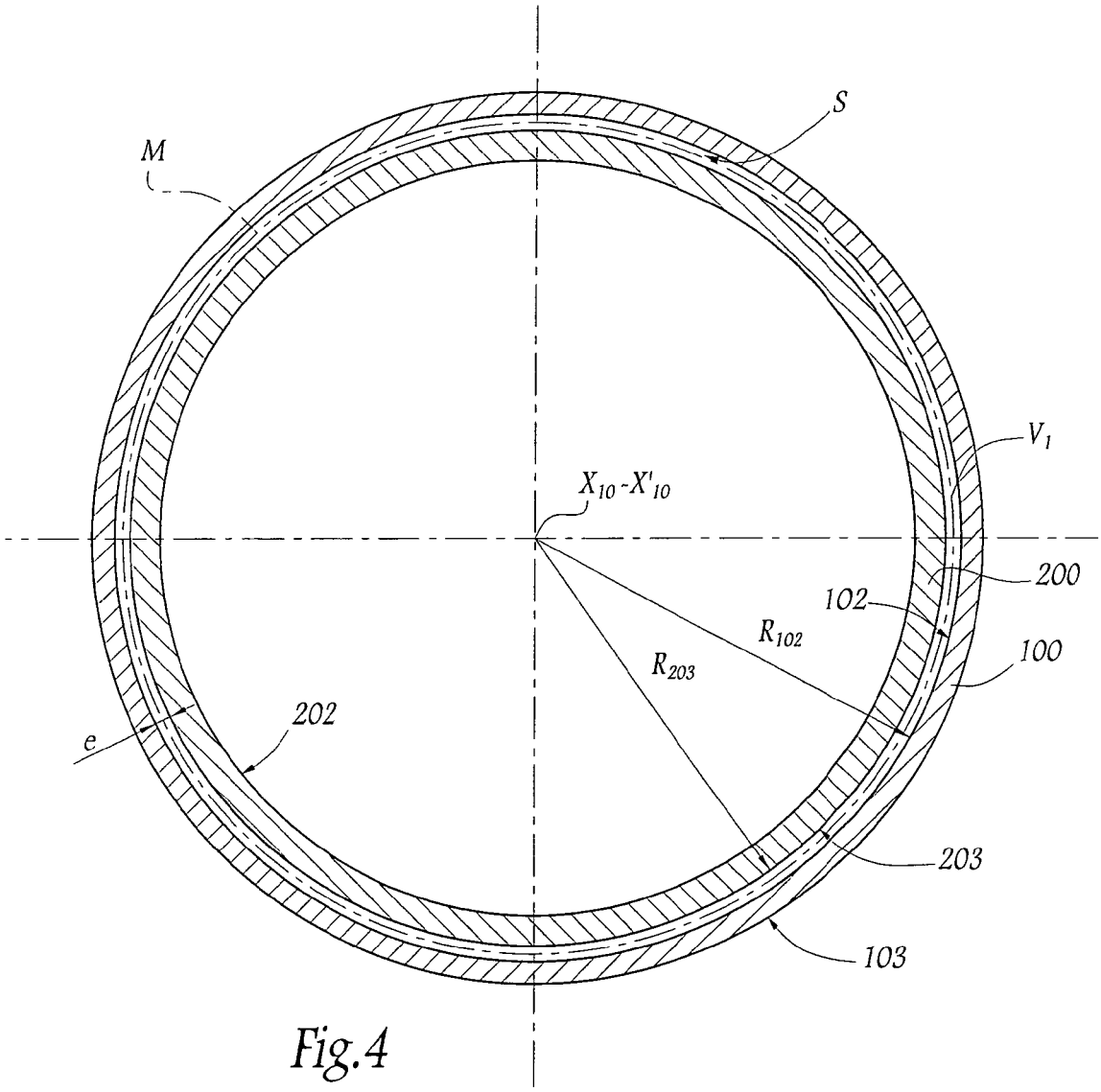
FIG. 4 is a section along the line IV-IV of FIG. 2.
Figure 5:
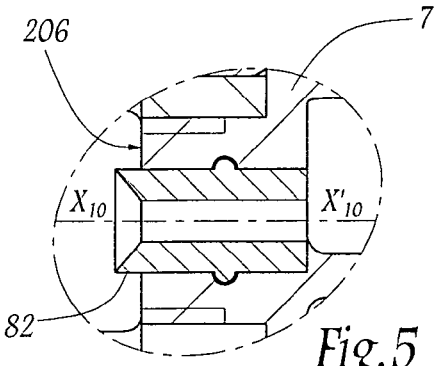
FIG. 5 is a view on a larger scale of the detail V of FIG. 2.

The difference measured between the two cups 100 and 200 perpendicularly at a midline M between the generatrices of the surfaces 102 and 103, that is to say the thickness of the volume $V_1$ is marked e. The thickness e is equal to the distance, between the inner surface 102 and the outer surface 203. Because of the geometry of the surfaces 102 and 203 which are symmetrical relative to the axis $X_{10}$-$X'_{10}$, the thickness e has, for a given position along the axis $X_{10}$-$X'_{10}$, the same value irrespective of the angular sector about the axis $X_{10}$-$X'_{10}$ in which it is measured, as can be seen in FIG. 4 where the thickness e is uniform. The thickness e determines the section S of passage of the volume $V_1$ which has an area equal to:

$$S=\pi\times e\times(R_{102}+R_{203})$$

where $R_{102}$ and $R_{203}$ are respectively the radii of the surfaces 102 and 203 which are circular.

The value of the thickness e measured at the zone of entrance of the product into the volume $V_1$ at the height of the rear face 63 of the assembly formed by the cup 200, the upper portion of the hub 6 and the distributor 8 is marked $e_1$. The value of the thickness e measured at the edge 101 of the cup 100 is marked $e_2$. The thickness e reduces continuously from $e_1$ to $e_2$, $e_2$ being less than $e_1$. As an example, $e_1$ may be 2 mm while $e_2$ is a few tenths of a millimeter.

The decrease in the value of e between the values $e_1$ and $e_2$ has the effect that the section S of passage of product in the volume $V_1$, which is annular as shown in FIG. 4, has an area which decreases between the entrance zone and the exit zone of this volume.

As a variant, the decrease in the value of the thickness e between the values $e_1$ and $e_2$ may occur in a noncontinuous manner, this thickness being able to be, for example, constant over a portion of the volume $V_1$.

In practice, the values $e_1$ and $e_2$ are chosen such that their ratio $R=e_1/e_2$ is less than 0.9, preferably less than 0.5. Completely satisfactory results have been obtained with R being of the order of 0.4.

During spraying, the spraying member 10 rotates about the axis $X_1$-$X'_1$. The two cups 100 and 200 are attached and rotate at the same time, at the same speed. The coating product is brought by the injector 5, hits the rear face 63 of the assembly consisting of the cup 200, the upper portion of the hub 6 and if necessary the protruding portion 82 of the distributor 8, and spreads over the inner surface of the cup 100 up to the spraying edge 101 where the liquid is divided into fine droplets. As it travels, the turbulence in the volume $V_1$ and the pressure drop, created in this volume by the acceleration of the product between the two cups under the effect of centrifugal force, carry droplets of coating product which are deposited on and substantially dirty the whole surface 203 up to the edge 201.

A fraction of the coating product brought by the injector 5 continues its journey directly into the distributor 8 through the orifice 81. This fraction is defined both by the geometry of the distributor 8, particularly the internal diameter of the orifice 81, and by the flow rate of coating product. This fraction hits the rear face 73 of the distributor 7 and spreads over the inner surface of the cup 200 up to the spraying edge 201 where the liquid is divided into fine droplets.

The diameter $D_{81}$ of the orifice 81 is less than or equal to the internal diameter $D_{51}$ of the downstream terminal portion 51 of the injector 5. This has the effect of ensuring that at least a portion of the product coming out of the injector is directed toward the volume $V_1$. It is possible to adjust the proportion of coating product directed toward the volume $V_1$ by varying the ratio $R'=D_{51}/D_{81}$.

For rinsing the spraying member, the user brings via the injector 5 streams of air-solvent, dimensioned with a flow rate making it possible to completely fill the volume $V_1$. The streams of air and of solvent follow the same paths as the coating product, from the injector 5 to the edges 101 and 201.

The reduction in the separation between the cups 100 and 200 from $e_1$ to $e_2$ has the effect of compensating for a reduction in pressure due to the centrifugal force and of slightly compressing the rinsing liquid in order to allow the complete filling of the volume $V_1$ when the spraying member is rinsed, which makes it possible to rinse the surface 102 and the surface 203 at the same time.

Therefore, the injection of cleaning product makes it possible to properly clean not only the inner surfaces 102 and 202 but also the surface 203.

In addition, the streams of air-solvent can create a foam, by dispersion of air in a liquid, which increases the effectiveness of the cleaning. It is also possible to provide that the cleaning product is itself a foaming product. In this case, the compression effect obtained due to the reduction in the thickness e is applied to the air bubbles that are present in the dispersion or in the foaming product, which creates a "scraper" effect of the air bubbles on the surfaces 102 and 203.

The cup 100 is pierced with a series of orifices 150 each of which extends between an entrance 150A situated on the surface 103 of the cup 100 and an exit 150B situated on the surface 102. The orifices 150 are cylindrical each centered on an axis $X_{150}$ which is oblique relative to the axis $X_{10}$-$X'_{10}$. The orifices 150 make it possible to generate an inlet of air via the outside to the volume $V_1$. These orifices are easy to produce because they can be pierced in the cup 100 before the cup 200 is installed.

The invention has been shown with a spreading member 10 comprising two cups. It can also be applied with a stack of three or more than three successive cups mounted in series terminated by the mounting of a distributor on the innermost cup. In this case, volumes $V_1, \ldots, V_{n-1}$ may be defined by analogy to the embodiment shown, with different geometries, each volume having a decreasing radial thickness, from its inlet zone to its outlet zone.

The invention has been shown with a spraying member 10 attached to the rotor 1 by magnetic effect. It can also be applied with a spraying member attached by any other means, in particular screwed.

The invention has been shown with cups 100 and 200 that can be disassembled. It can also be applied with a member the cups of which cannot be disassembled, for example cups that are made in one piece.

The invention has been shown with a cup 100 the edge 101 of which has a diameter $D_{101}$ that is greater than the diameter $D_{201}$ of the edge 201 of the cup 200. However, the invention can be applied to the case in which the diameter $D_{101}$ is equal to or slightly smaller than the diameter $D_{201}$, which is possible because of the distance $d_1$ by which the edge 101 is set back from the edge 201.

The invention claimed is:

1. A spraying device for spraying a liquid coating product comprising a spraying member, means for rotating said spraying member and means for supplying coating product to said spraying member, wherein said spraying member comprises an outer cup and an inner cup, each cup having a spraying edge, an inner distribution surface for distribution of the same coating product and an outer surface, the inner cup being placed radially inside the outer cup, while an annular volume defined between the inner distribution surface of the outer cup and the outer surface of the inner cup has a decreasing thickness between a first thickness value, taken near the zone of inlet into the volume, and a second thickness value, taken at the spraying edge of the outer cup, and a single central supply means for supplying the same coating product to both inner distribution surfaces of the cups from a back face of the spraying member, wherein the central supply means of the spraying member comprise a distributor provided with an orifice aligned on an axis of symmetry of the inner surfaces and outer surfaces of the cups, this orifice being designed to supply the inner distribution surface of the inner cup with coating product, and the diameter of said orifice is less than or equal to the internal diameter of the downstream end of the means for supplying coating product.

2. The spraying device as claimed in claim 1, wherein the supply means comprise a deflector mounted in the inner cup, facing a central portion of its inner distribution surface.

3. The spraying device as claimed in claim 1, wherein the ratio of the second value over the first value is less than 0.9.

4. The spraying device as claimed in claim 1, wherein the spraying edge of the outer cup is axially set back relative to the spraying edge of the inner cup by a distance greater than 1% of the diameter of the spraying edge of the inner cup.

5. The spraying device as claimed in claim 1, wherein the outer cup is provided with orifices for the inlet of air towards the volume defined between the outer surface of the inner cup and the inner surface of the outer cup.

6. An installation for spraying coating product, wherein it comprises at least one spraying device as claimed in claim 1.

7. A method for cleaning the spraying member of the spraying device as claimed in claim 1, wherein it comprises a step consisting in completely filling said volume with cleaning product and/or with air.

8. The method as claimed in claim 7, wherein it consists in using, in order to completely fill said volume, a cleaning product or a mixture of cleaning product and foaming air.

9. A cleaning method comprising:

providing the spraying device as claimed in claim 1; and cleaning said spraying member by completely filling said volume with cleaning product and/or with air.

10. The method as claimed in claim 9, wherein said step of cleaning consists in using, in order to completely fill said volume, a cleaning product or a mixture of cleaning product and foaming air.

11. The spraying device as claimed in claim 3, wherein the ratio of the second value over the first value is less than 0.5.

12. The spraying device as claimed in claim 3, wherein the ratio of the second value over the first value is 0.4.

13. The spraying device as claimed in claim 1, wherein the ratio of the second thickness value over the first thickness value is greater than zero.

* * * * *